United States Patent [19]

Bauer et al.

[11] 4,370,853

[45] Feb. 1, 1983

[54] FRICTION FALSE TWISTING APPARATUS

[75] Inventors: Karl Bauer; Heinz Schippers; Peter Dammann, all of Remscheid, Fed. Rep. of Germany

[73] Assignee: Barmag Barmer Maschinenfabrik AG, Remscheid, Fed. Rep. of Germany

[21] Appl. No.: 306,163

[22] Filed: Sep. 28, 1981

Related U.S. Application Data

[63] Continuation-in-part of Ser. No. 272,936, Jun. 12, 1981, which is a continuation-in-part of Ser. No. 168,734, Jul. 14, 1980, Pat. No. 4,339,915.

[30] Foreign Application Priority Data

| | | | |
|---|---|---|---|
| Jul. 14, 1979 | [DE] | Fed. Rep. of Germany | 2928522 |
| Jun. 26, 1980 | [DE] | Fed. Rep. of Germany | 3023887 |
| Jun. 15, 1981 | [DE] | Fed. Rep. of Germany | 3123753 |
| Jun. 26, 1981 | [JP] | Japan | 56-98481 |
| Jun. 11, 1981 | [CH] | Switzerland | 3827/81 |
| Jun. 11, 1981 | [CH] | Switzerland | 3830/81 |
| Jun. 26, 1981 | [GB] | United Kingdom | 8119754 |

[51] Int. Cl.[3] ..... D02G 1/08

[52] U.S. Cl. ..... 57/340; 57/339; 57/348

[58] Field of Search ..... 57/334, 340, 348, 349

[56] References Cited

U.S. PATENT DOCUMENTS

| | | | |
|---|---|---|---|
| 2,863,280 | 12/1958 | Ubbelohde | 57/336 X |
| 3,156,084 | 11/1964 | Van Dijk et al. | 57/340 |
| 3,225,533 | 12/1965 | Henshaw | 57/340 X |
| 3,373,554 | 3/1968 | Raschle | 57/340 |
| 3,394,540 | 7/1968 | Bentov | 57/337 X |
| 3,488,941 | 1/1970 | Asaka | 57/340 X |
| 3,495,391 | 2/1970 | Njo | 57/340 |
| 4,050,229 | 9/1977 | Hayahusa | 57/340 X |
| 4,145,871 | 3/1979 | Iwata et al. | 57/340 |
| 4,149,366 | 4/1979 | Bass et al. | 57/339 X |

FOREIGN PATENT DOCUMENTS

| | | |
|---|---|---|
| 2001120 | 7/1971 | Fed. Rep. of Germany . |
| 2121917 | 8/1971 | France . |
| 1375380 | 11/1974 | United Kingdom . |
| 1421662 | 1/1976 | United Kingdom . |

*Primary Examiner*—John Petrakes

*Attorney, Agent, or Firm*—Bell, Seltzer, Park & Gibson

[57] ABSTRACT

A yarn false twisting apparatus is disclosed which comprises a pair of circular discs which are mounted for rotation about generally parallel spaced apart axes, and such that portions of the surfaces are disposed in opposing face to face relation and define a twisting zone therebetween. One disc is mounted to its supporting shaft by means of an elastomeric body member, which permits the disc to resiliently incline with respect to the axis of the shaft. A pressure applying member acts upon the back side of such disc to resiliently bias the same toward the other disc at the twisting zone.

4 Claims, 2 Drawing Figures

FRICTION FALSE TWISTING APPARATUS

Figure 1:
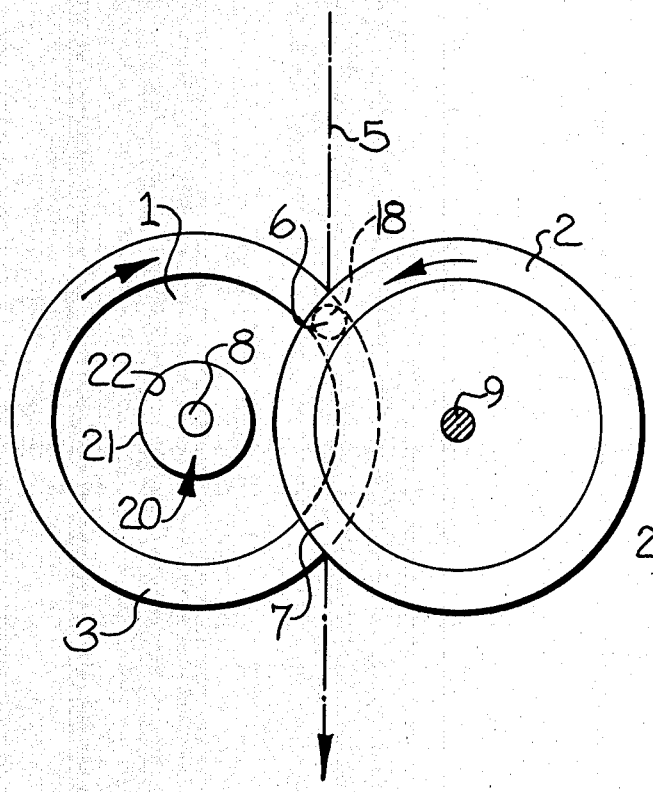

The present application is a continuation-in-part of copending application Ser. No. 272,936, filed June 12, 1981, which in turn is a continuation-in-part of co-pending application Ser. No. 168,734, filed July 14, 1980, now U.S. Pat. No. 4,339,915.

Yarn false twisting apparatus for the false twist texturing of synthetic filaments are known, and which consist of two circular discs which are rotated in opposite directions. Typically, the axes of rotation are inclined toward each other and the peripheral edges of the discs contact each other at the twisting zone. In one apparatus of this type, note German Patent Publication 1,192,779 and U.S. Pat. No. 4,145,871, the rotary discs are movable in the axial direction toward and away from each other and the discs are mechanically pressed against each other by spring pressure. The yarn is advanced along a path of travel which extends in a direction essentially perpendicular to the common plane of the two axes of rotation.

The above known friction false twist apparatus have not proved entirely successful in the industry however, since unavoidable inaccuracies in the manufacture, such as non-uniform bearing clearances, have led to slightly pulsating movements, of one or both discs. As a result, the yarn is nipped with a pulsating or fluttering force, and is non-uniformly twisted and crimped.

It is an object of the present invention to avoid the above limitations of the known false twisting apparatus. These and other objects and advantages of the present invention are achieved in the illustrated embodiments by the provision of a false twisting apparatus of the described type, and which includes means for resiliently biasing one of the rotating discs toward the other disc or twist imparting member only at the twisting zone. In the specific illustrated embodiment, the disc is relatively rigid, and it is mounted to its supporting shaft by a gimbal-like interconnection which permits the disc to incline with respect to the axis of the shaft. A pressure applying member is mounted adjacent the circular disc on the side opposite the friction surface and in alignment with the twisting zone, to bias the disc toward the other member at the twisting zone. Also, the gimbal-like interconnection takes the form of an elastomeric body member which is interposed between the disc and shaft, and such that the disc may resiliently incline with respect to the axis of the shaft.

An advantage of the present invention resides in the fact that even in the event the disc is somewhat out of true run, it does not perform any transitory movements, i.e., movements effecting the nipping force and thus a constant nipping force can be provided by the pressure applying means.

The pressure applying member which acts upon the back side of the disc may be in the form of a roll or plunger, which is connected to a resilient supply of force, such as a pneumatic cylinder-piston assembly, spring, magnet, or the like.

In the present case, it is also advantageous that the pressure applying means insures a proper frictional engagement, in that the nipping gap is automatically adjusted to the particular yarn size or diameter.

Some of the objects and advantages of the invention having been stated, others will appear as the description proceeds, when taken in connection with the accompanying drawings, in which--

Figure 1A:
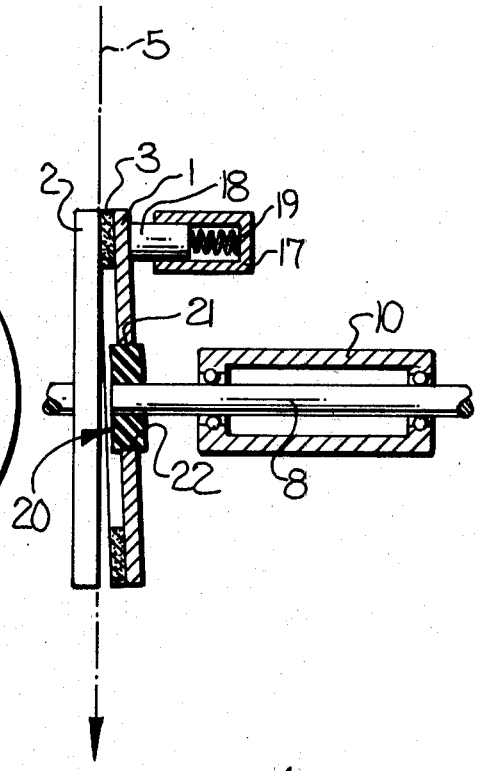

FIG. 1 is a schematic front elevation view of a false twisting apparatus embodying the present invention; and FIG. 1*a* is a sectional side elevation view of the apparatus shown in FIG. 1.

Referring more specifically to the drawings, FIGS. 1 and 1*a* schematically illustrate a preferred embodiment of a friction false twisting apparatus in accordance with the present invention, and which comprises discs 1 and 2 which are driven in opposite directions. Both discs are relatively rigid, and the disc 1 is provided with a frictional surface coating 3. An advancing yarn 5 is adapted to be nipped in the nipping area or twisting zone 6, in the manner further described in the above referenced copending applications.

The discs 1 and 2 are mounted on the shafts 8 and 9 respectively, with the shafts being mounted for rotation about generally parallel spaced apart axes by bearings 10 or the like. The disc 2 is fixedly mounted to its supporting shaft 9, while the disc 1 is mounted to its supporting shaft 8 by a gimbal-like interconnection (Cardanic) which permits the disc to resiliently incline with respect to the axis of the shaft 8. In the illustrated embodiment, the gimbal-like interconnection for mounting the disc 1 to its shaft 8, includes an elastomeric body member 20 which is interposed between the disc 1 and shaft 8 so as to permit the disc to resiliently incline from its usual perpendicular relationship with respect to the axis of the shaft. The elastomeric body member 20 may consist of any suitable rubber or plastic material, and it is fixedly mounted on the shaft 8. Further, the body member includes a circular outer periphery 21 which is coaxial with the axis of the shaft 8. The disc 1 further includes an inner circular rim 22 which is fixedly mounted to the periphery 21 of the body member by adhesive or other similar means.

A pressure applying member 17 acts upon the back side of the disc 1. The member 17 includes a plunger 18 and spring 19, and resiliently presses the disc 1 against the yarn in the area 6. As a result, the disc 1 inclines from the plane normal to its axis of the shaft 8 and so that the gap for the thread line in the area of overlap 7 on the other side of the shafts 8 and 9 widens to permit the yarn to freely pass therethrough.

The illustrated construction of the discs and mounting means therefor, with the use of a resilient pressure applying member, makes it possible to false twist high denier yarns at very high twists, and to thereby obtain a high degree of crimping of such yarns.

In the drawings and specification, there has been set forth a preferred embodiment of the invention and although specific terms are employed, they are used in a generic and descriptive sense only and not for purposes of limitation. In this regard, it will be understood that the relative dimensions of the body member 20 and disc 1 may vary depending upon the materials utilized and operating parameters, and thus the illustrated relative dimensions should be considered exemplary only.

That which is claimed is:

1. A yarn false twisting apparatus comprising a pair of twist imparting members, with each member including a yarn engaging friction surface, and at least one of said members comprising a circular disc, means rotatably mounting said twist imparting members such that portions of the respective yarn engaging friction surfaces are disposed in opposing, face to face relationship and define a twisting zone therebetween, said mounting means for said circular disc including a supporting shaft and an elastomeric body member interposed between said circular disc and said shaft so as to permit said disc to resiliently incline with respect to the axis of said shaft, drive means for operatively rotating each of said twist imparting members about their respective axes, and means for resiliently biasing said circular disc toward the other member only at said twisting zone, whereby a yarn may be continuously moved through said twisting zone while having twist imparted thereto by frictional contact between the yarn and the respective opposed friction surfaces.

2. The yarn false twisting apparatus as defined in claim 1 wherein said elastomeric body member has a generally circular periphery which is coaxial with the axis of said supporting shaft, and said disc is relatively rigid and includes an inner circular rim which is fixedly mounted to said periphery of said elastomeric body.

3. The yarn false twisting apparatus as defined in either claim 1 or 2 wherein said biasing means comprises a pressure applying member mounted adjacent said circular disc so as to operatively contact said disc on the side opposite said friction surface and in alignment with said twisting zone.

4. The yarn false twisting apparatus as defined in claim 3 wherein each of said twist imparting members comprises a relatively rigid circular disc.

* * * * *